US007290487B2

(12) United States Patent
Hiller

(10) Patent No.: US 7,290,487 B2
(45) Date of Patent: Nov. 6, 2007

(54) METHOD FOR PRODUCING FLEXO PRINTING FORMS BY MEANS OF LASER DIRECT ENGRAVING

(75) Inventor: Margit Hiller, Karlstadt (DE)

(73) Assignee: XSYS Print Solutions Deutschland GmbH, Stuttgart (DE)

( * ) Notice: Subject to any disclaimer, the term of this patent is extended or adjusted under 35 U.S.C. 154(b) by 187 days.

(21) Appl. No.: 10/513,757

(22) PCT Filed: Jun. 16, 2003

(86) PCT No.: PCT/EP03/06331

§ 371 (c)(1),
(2), (4) Date: Nov. 9, 2004

(87) PCT Pub. No.: WO03/107092

PCT Pub. Date: Dec. 24, 2003

(65) Prior Publication Data

US 2005/0166779 A1 Aug. 4, 2005

(30) Foreign Application Priority Data

Jun. 18, 2002 (DE) ..... 102 27 189

(51) Int. Cl.
*B41N 6/00* (2006.01)

(52) U.S. Cl. ..... 101/401.1; 101/395

(58) Field of Classification Search ..... 101/401.1, 101/395, 483, 492, 402, 404, 150, 487; 430/270.1, 430/306, 307
See application file for complete search history.

(56) References Cited

U.S. PATENT DOCUMENTS 4,197,130 A * 4/1980 Nakamura et al. ..... 430/286.1
5,259,311 A 11/1993 McCaughey, Jr.
5,262,275 A 11/1993 Fan
5,719,009 A 2/1998 Fan
5,798,202 A 8/1998 Cushner et al.
5,804,353 A 9/1998 Cushner et al.
6,025,098 A * 2/2000 Sakurai et al. ..... 430/18
6,037,102 A 3/2000 Loerzer et al.
6,238,837 B1 5/2001 Fan
6,558,876 B1 5/2003 Fan
6,576,399 B1 6/2003 Gries et al.
6,627,385 B2 9/2003 Hiller et al.
6,794,115 B2 * 9/2004 Telser et al. ..... 430/273.1
6,844,142 B2 * 1/2005 Schadebrodt et al. ..... 430/306
2001/0044076 A1 11/2001 Hiller et al.

FOREIGN PATENT DOCUMENTS

| | | |
|---|---|---|
| DE | 199 08 528 | 8/2000 |
| EP | 0 640 043 | 1/1996 |
| EP | 0 640 044 | 3/1996 |
| EP | 0 767 407 | 9/1996 |
| EP | 0 654 150 | 3/1997 |
| EP | 0 741 330 | 11/1999 |
| EP | 1 136 254 A2 | 9/2001 |
| EP | 1 136 254 B1 | 5/2003 |

OTHER PUBLICATIONS

Imaging Technology, Chapter 3.4.1.2 Coating and Further Processing, Ullmann's Encyclopedia of Industrial Chemistry, 6th Edition, 2000 Electronic Release.

* cited by examiner

*Primary Examiner*—Anthony H. Nguyen
(74) *Attorney, Agent, or Firm*—Nixon & Vanderhye PC

(57) ABSTRACT

Flexographic printing plates are produced by means of direct laser engraving by a process in which the starting material used is a flexographic printing element, the relief-forming layer of which has a combination of a substantially hydrophobic, elastomeric binder and an inert plasticizer. Flexographic printing plates obtainable by this process are used for flexographic printing with water-based or alcohol-based printing inks.

11 Claims, No Drawings

METHOD FOR PRODUCING FLEXO PRINTING FORMS BY MEANS OF LASER DIRECT ENGRAVING

This application is the US national phase of international application PCT/EP03/06331 filed 16 Jun. 2003 which designated the U.S. and claims benefit of DE 102 27 189.5, dated 18 Jun. 2002, the entire content of which is hereby incorporated by reference.

The present invention relates to a process for the production of flexographic printing plates by means of direct laser engraving, in which the starting material used is a flexographic printing element, the relief-forming layer of which has a combination of a substantially hydrophobic, elastomeric binder and an inert plasticizer. The present invention furthermore relates to flexographic printing plates obtainable by this process and the use of flexographic printing plates for flexographic printing with water-based or alcohol-based printing inks.

Lasers are now used both in the area of offset printing plates and in the area of relief printing plates for various steps of the production process.

For example, it is known that the photosensitive layers of offset printing plates can be inscribed imagewise by means of suitable laser exposure units. The photosensitive layer is chemically modified, for example crosslinked, by the laser. The finished offset printing plate is obtained from the image-bearing crude product by means of a suitable development process (cf. for example Imaging Technology, Section 3.4.1.2., Ullmann's Encyclopedia of Industrial Chemistry, $6^{th}$ Edt., 2000 Electronic release). The thickness of said photosensitive layers of offset printing plates is usually from 0.3 to 5 μm.

It is furthermore known that images can be produced from flexographic printing plates with the use of IR-ablative masks, as disclosed, for example, in EP-A 654 150, instead of photographically produced masks. Here, a thin IR-sensitive, opaque layer is applied to the photopolymerizable layer. The thickness of such IR-ablative layers is usually just a few μm. The IR-ablative layer is inscribed imagewise using an IR laser, i.e. the parts in which the laser beam is incident on it are removed. The actual printing relief-forming is produced in the conventional manner: exposure is effected to actinic light through the mask produced, and the relief layer is thus selectively crosslinked. Development is then effected with a developer in a conventional manner, both photosensitive material from the unexposed parts of the relief-forming layer and the residues of the IR-ablative layer being removed. Since the IR-ablative mask layer is of no importance for the actual printing process, the materials therefor can be sought exclusively with regard to the optimum use as a mask.

In direct laser engraving for the production of flexographic printing plates, on the other hand, a printing relief is engraved directly into the relief-forming layer of a flexographic printing element by means of a laser. A subsequent development step, as in the case of conventional plates or in the mask process, is no longer required. Typical relief layer thicknesses of flexographic printing plates are from 0.5 to 7 mm and may also be 0.2 mm in the case of special thin-film plates. The nonprinting wells in the relief are at least 0.03 mm in the screen area and substantially more in the case of other negative elements and may assume values up to 3 mm in the case of thick plates. Thus, large amounts of material have to be removed by means of the laser.

EP-A 640 043 and EP-A 640 044 disclose one-layer or multilayer elastomeric laser-engravable flexographic printing elements for the production of flexographic printing plates by means of laser engraving. The elements consist of reinforced elastomeric layers. Elastomeric binders are used for the production of the layer. The mechanical strength of the layer is increased by the reinforcement, in order to permit flexographic printing. The reinforcement is achieved either by introduction of suitable fillers, photochemical or thermochemical crosslinking or combinations thereof.

U.S. Pat. No. 5,259,311 discloses a process in which a commercial flexographic printing element is photochemically crosslinked by uniform exposure to UV/A in a first step, the release layer is then removed using a flexographic washout agent and a printing relief is engraved by means of a laser in a second step. A cleaning step is then carried out by means of a flexographic washout agent, followed by final drying of the plate.

Although the engraving of rubber impression cylinders by means of lasers has in principle been known since the 60s of the last century and the patents cited have also been filed 10 years ago, laser engraving has acquired broader commercial interest only in recent years with the advent of improved laser systems. The improvements in the laser systems include better focusability of the laser beam, higher power and computer-controlled beam modulation.

With the introduction of new, more efficient laser systems, however, the question of particularly suitable materials for laser-engravable flexographic printing plates is becoming increasingly important. Problems which played no role at all in the past because the laser systems did not at all allow the engraving of very fine structures are now important and lead to new requirements with respect to the material.

The relief layers of flexographic printing plates are of course soft and have relatively low melting or softening points. In laser engraving, they therefore have a strong tendency to form melt edges around the engraved elements. At the edge of the engraved elements, the layer melts under the influence of the laser beam but is not, or not completely, decomposed. Such melt edges cannot be removed or at least cannot be completely removed even by subsequent washing and lead to a blurred print. Undesired melting of the layer furthermore results in reduced resolution of the print motif in comparison with the digital data record.

EP-A 1 136 254 proposes the use of polyoxyalkylene/polyethylene glycol graft copolymers as binders for relief-forming layers for solving this problem. However, since these copolymers are water-soluble, such relief printing plates have the disadvantage that they can be used only to a limited extent. The relief layer swells to an excessive extent in water-based flexographic printing inks, so that undesired effects, for example an intolerable increase in tonal value, occur during printing. Such printing plates can therefore be used substantially only for printing with UV inks. There is an urgent need to provide laser-engravable relief printing elements which are also suitable for printing with water-based inks and nevertheless can be engraved with lasers without undesirably strong melting of the layer.

Furthermore, the degradation products which form in the course of the laser engraving frequently give rise to problems. In addition to gaseous fractions, aerosols are also produced. These are as a rule extremely tacky and may be wholly or partly deposited again on the surface of the printing relief and, in unfavorable cases, can even react again with the surface. This leads to unclean surfaces and hence also to poor printing behavior.

For solving this problem, U.S. Pat. No. 5,259,311 proposes subsequently cleaning the surface of the relief printing plate after the laser engraving with the aid of an organic solvent. However, the tacky decomposition products have substantially the same solubility behavior as the relief layer. For relief layers comprising hydrophobic polymers, an organic solvent therefore also has to be used for removing the decomposition products. The crosslinked relief layer is no longer soluble therein but may well still be swellable. After such a subsequent washing step, the layer therefore has to be dried again in a further process step. The time and handling advantage achieved by laser engraving in the process is eliminated again since the drying process takes the most time in the course of processing. Decomposition products which have reacted again with the surface can no longer be removed at all and are consequently also detectable in the print. It will be extremely desirable to be able to have a flexographic printing element in which possible deposits can be removed simply with water or aqueous cleaning agents without the plate swelling thereby.

Very rapid engraving is furthermore required for the economical production of flexographic printing plates by means of laser engraving. The speed of the engraving depends on the one hand on the laser system chosen. On the other hand, the sensitivity of the relief-forming layer to the laser radiation chosen in each case should be very high. With regard to the sensitivity, however, it should be taken into account that the relief layer of the flexographic printing plate imparts both the elastomeric properties and the typical printing properties. Measures for improving the sensitivity therefore must not impair said properties.

It is an object of the present invention to provide a process for the production of flexographic printing plates by means of direct laser engraving, in which the occurrence of melt edges is substantially reduced, possible deposits of decomposition products can be removed by simple treatment of the plate with water or aqueous cleaning agents and very rapid engraving with high resolution is made possible and in which the flexographic printing plates obtained are moreover suitable for printing with water-based flexographic printing inks.

We have found that this object is achieved by a process for the production of flexographic printing plates by means of laser engraving, in which the starting material used is a crosslinkable, laser-engravable flexographic printing element which at least comprises, arranged one on top of the other, a dimensionally stable substrate, at least one crosslinkable, laser-engravable relief-forming layer having a thickness of at least 0.2 mm, at least comprising a substantially hydrophobic, elastomeric binder, a plasticizer and crosslinkable components which process comprises at least the following steps:

(a) uniform crosslinking of the relief-forming layer and (b) engraving of a printing relief into the crosslinked relief-forming layer with the aid of a laser, the height of the relief elements engraved with the laser being at least 0.03 mm, the binder plasticizer being an inert plasticizer.

Flexographic printing plates which are obtainable by the process described and the use of these flexographic printing plates for flexographic printing with water-based and/or alcohol-based printing inks have furthermore been found.

Surprisingly, it has been found that flexographic printing elements which have excellent sensitivity to lasers are obtained by the novel combination of a substantially hydrophobic, elastomeric binder with inert plasticizers. The relief-forming layer scarcely melts under the influence of the laser radiation, and scarcely any melt edges form around the negative elements.

Regarding the present invention, the following may be stated specifically:

Examples of suitable dimensionally stable substrates for the flexographic printing elements used as starting materials for the process are plates, sheets and conical and cylindrical sleeves of metals, such as steel, aluminum, copper or nickel, or of plastics, such as polyethylene terephthalate (PET), polyethylene naphthalate (PEN), polybutylene terephthalate, polyamide, polycarbonate, if required also woven fabrics and nonwovens, such as glass fiber fabrics, and composite materials, for example of glass fibers and plastics. Particularly suitable dimensionally stable substrates are dimensionally stable substrate sheets, for example polyester sheets, in particular PET or PEN sheets, or flexible metallic substrates, such as thin metal sheets or metal foils of steel, preferably of stainless steel, magnetizable spring steel, aluminum, zinc, magnesium, nickel, chromium or copper.

The flexographic printing element furthermore comprises at least one laser-engravable, crosslinkable relief-forming layer. The crosslinkable relief-forming layer may be applied directly on the substrate. However, other layers, for example adhesion-promoting layers and/or resilient lower layers, may also be present between the substrate and the relief-forming layer.

The crosslinkable relief-forming layer comprises at least one substantially hydrophobic, elastomeric binder, crosslinkable components and at least one inert plasticizer. As a rule, the crosslinkable relief-forming layer as a whole already has elastomeric properties; for the present invention, however, it is sufficient if the crosslinked layer first has the elastomeric properties typical of a flexographic printing plate.

The substantially hydrophobic elastomers are those which are usually used for the preparation of conventional flexographic printing plates developable in an organic medium and which are neither soluble nor swellable in water. Examples are natural rubber, polybutadiene, polyisoprene, styrene/butadiene rubber, nitrile/butadiene rubber, butyl rubber, styrene/isoprene rubber, polynorbornene rubber or ethylene/propylene/diene rubber (EPDM).

The substantially hydrophobic elastomer is preferably a thermoplastic elastomeric block copolymer of alkenylaromatics and 1,3-dienes. The block copolymers may be both linear block copolymers and radial block copolymers. They are usually three-block copolymers of the A-B-A type and may also be two-block polymers of the A-B type, or those having a plurality of alternating elastomeric and thermoplastic blocks, e.g. A-B-A-B-A. Mixtures of two or more different block copolymers may also be used. Commercial three-block copolymers frequently contain certain amounts of two-block copolymers. The diene units may be 1,2- or 1,4-linked. Both block copolymers of the styrene/butadiene type and of the styrene/isoprene type may be used. They are commercially available, for example, under the name Kraton®. Thermoplastic elastomeric block copolymers having terminal blocks comprising styrene and a random styrene/butadiene middle block, which are available under the name Styroflex®, may furthermore be used. The block copolymers may also be completely or partly hydrogenated, as, for example, in SEBS rubbers.

Of course, mixtures of a plurality of binders may also be used, provided that the properties of the relief-forming layer are not adversely affected thereby. The total amount of binders is usually from 40 to 80, preferably from 40 to 70, particularly preferably from 40 to 65, % by weight, based on the sum of all components of the relief layer.

For the novel process, the substantially hydrophobic binder is used as a mixture with at least one inert plasticizer.

In the context of this invention, inert means that the plasticizers have no or at least substantially no polymerizable groups which can react in the course of free radical crosslinking of the relief layer in such a way that the plasticizers are also incorporated into the polymeric network of the relief-forming layer. Inert plasticizers have in particular substantially no ethylenically unsaturated double bonds.

It is of course known to a person skilled in the art that in principle also single C—H bonds can react by the chain transfer route in the course of free radical polymerization. However, this is not intended to contradict the term inert, since it is also known to a person skilled in the art that this reaction will take place only to a minor extent compared with the reaction of ethylenically unsaturated double bonds.

Examples of suitable inert plasticizers include in particular alkyl esters of alkanecarboxylic acids, in particular alkanedicarboxylic acids, arylcarboxylic acids or phosphoric acid. Preferred alcoholic components of the esters are straight-chain or branched $C_8$- to $C_{20}$-alkanols, particularly preferably $C_8$- to $C_{13}$-alkanols, such as n-octanol, 2-ethylhananol, n-nonanol, isononanol, n-decanol, isodecanol, n-undecanol, isoundecanol, n-dodecanol, isododecanol, n-tridecanol and isotridecanol. The term "iso" alkanols is understood in the case of said compounds as meaning a mixture of different isomers which are usually obtained in the industrial synthesis of the alkanols. Preferred carboxylic components in the esters are in particular alkanedicarboxylic acids of at least 6 carbon atoms, for example adipic acid, azelaic acid, sebacic acid and phthalic acid. Suitable diesters may be both symmetrical esters and those which have two different alcoholic groups. Examples of ester-based inert plasticizers include di-2-ethylhexyl phthalate, di-2-ethylhexyl adipate, diisononyl adipate, diisodecyl phthalate, diisoundecyl phthalate, undecyl dodecyl phthalate, ditridecyl phthalate and ditridecyl adipate.

Further examples of inert plasticizers include high-boiling paraffinic, naphthenic and aromatic mineral oils. Such mineral oils are obtained by distillation of mineral oils under reduced pressure.

High-boiling substantially paraffinic and/or naphthenic mineral oils are preferred. Such mineral oils are also referred to as white oils, a person skilled in the art distinguishing between technical-grade white oils which can still have a low content of aromatics, and medical white oils, which are substantially free of aromatics. They are commercially available, for example Shell Risella (technical-grade white oil) or Shell Ondina (medical white oil).

Medical white oils are very particularly preferred.

Of course, mixtures of different plasticizers may also be used, provided that the properties of the relief-forming layer are not adversely affected thereby.

The amount of inert plasticizer is used by a person skilled in the art in effective amounts depending on the desired properties of the layer. As a rule, at least 5% by weight, based on the sum of all components of the relief layer, of inert plasticizer are required. This does not of course exclude the possibility that, in exceptional cases, effective results can also be achieved in storage engraving with smaller amounts. As a rule, the amount of inert plasticizer is from 5 to 40, preferably from 10 to 40, particularly preferably from 20 to 40, % by weight, based on the sum of all components of the layer.

The type and amount of the components for the crosslinking of the layer depend on the desired crosslinking technique and are chosen accordingly by a person skilled in the art. The uniform crosslinking of the crosslinkable relief layer is, in particular, carried out photochemically or thermochemically. The crosslinking is preferably carried out photochemically.

In the case of the photochemical crosslinking, the relief-forming layer comprises at least one photoinitiator or a photoinitiator system and suitable monomers or oligomers.

Benzoin and benzoin derivatives, such as α-methylbenzoin and benzoin ethers, benzil derivatives, such as benzil ketals, acylarylphosphine oxides, acylarylphosphinic esters and polynuclear quinones are suitable in a known manner as initiators for the photopolymerization, there being no intention to restrict the list to these.

The monomers have at least one polymerizable, olefinically unsaturated group. Esters or amides of acrylic acid or methacrylic acid with mono- or polyfunctional alcohols, amines, aminoalcohols or hydroxyethers and hydroxyesters, styrene or substituted styrenes, esters of fumaric or maleic acid or allyl compounds have proven particularly advantageous. Examples of suitable monomers include butyl acrylate, 2-ethylhexyl acrylate, lauryl acrylate, 1,4-butanediol diacrylate, 1,6-hexanediol diacrylate, 1,6-hexanediol dimethacrylate, 1,9-nonanediol diacrylate, trimethylolpropane triacrylate, dioctyl fumarate and N-dodecylmaleimide. Suitable oligomers having olefinic groups may also be used. It is of course also possible to use mixtures of different monomers or oligomers, provided that no undesired effects occur. The total amount of the monomers is established by a person skilled in the art according to the desired properties of the layer. As a rule, however, 20% by weight, based on the amount of all components of the laser-engravable relief-forming layer, should not be exceeded.

Thermal crosslinking can, on the one hand, be carried out analogously to the photochemical crosslinking, by using a thermal polymerization initiator instead of a photoinitiator. Commercial thermal initiators for free radical polymerization, for example peroxides, hydroperoxides or azo compounds, are in principle suitable. The thermal crosslinking may also be carried out by adding a heat-curable resin, for example an epoxy resin, as a crosslinking component to the layer.

The crosslinkable relief-forming layer can optionally furthermore comprise an absorber for laser radiation. Mixtures of different absorbers for laser irradiation may also be used. Suitable absorbers for laser radiation have a high absorption in the region of the laser wavelength. Particularly suitable absorbers are those which have a high absorption in the near infrared and in the longer-wave VIS range of the electromagnetic spectrum. Such absorbers are particularly suitable for the absorption of the radiation of Nd-YAG lasers (1 064 nm) and of IR diode lasers, which typically have wavelengths of from 700 to 900 nm and from 1 200 to 1 600 nm.

Examples of suitable absorbers for laser radiation are dyes which absorb strongly in the infrared spectral range, for example phthalocyanines, naphthalocyanines, cyanines, quinones, metal complex dyes, such as dithiolenes, or photochromic dyes. Further suitable absorbers are inorganic pigments, in particular intensely colored inorganic pigments, for example chromium oxides, iron oxides, carbon black or metallic particles. Particularly suitable absorbers for laser radiation are finely divided carbon black grades having a primary particle size of from 10 to 50 nm.

The amount of the optionally added absorber is chosen by a person skilled in the art according to the respective desired properties of the laser-engravable flexographic printing element. In this context, a person skilled in the art will take into account the fact that the added absorbers influence not only the engraving of the elastomeric layer by laser but also other properties of the relief printing plate obtained as the end product of the process, for example its hardness, resilience, thermal conductivity or ink transfer behavior. As a rule, it is therefore advisable to use not more than 20% by weight at most, preferably not more than 10% by weight, based on the sum of all components of the layer, of absorber for laser radiation.

As a rule, it is not advisable to add to relief-forming layers which are to be photochemically crosslinked absorbers for laser radiation which also absorb in the UV range, since the photopolymerization is at least greatly impaired thereby and may be rendered completely impossible. It is advisable as a rule to subject such relief layers containing laser absorbers to thermal crosslinking.

The relief-forming layer may furthermore comprise additives and assistants, for example dyes, dispersants or antistatic agents. However, the amount of such additives should as a rule not exceed 5% by weight, based on the amount of all components of the crosslinkable, laser-engravable layer of the recording element.

The crosslinkable relief-forming layer may also be composed of a plurality of part-layers. These crosslinkable part-layers may be of the same, roughly the same or different material composition.

The thickness of the laser-engravable, elastomeric relief-forming layer is at least 0.2, preferably from 0.3 to 7, particularly preferably from 0.5 to 5, very particularly preferably from 0.7 to 4, mm. The thickness is suitably chosen by a person skilled in the art according to the desired use of the flexographic printing plate.

In a preferred embodiment, the starting material comprises an additional laser-engravable polymer layer which is soluble or at least swellable in aqueous media and is arranged on the laser-engravable relief layer, and which comprises at least one polymer soluble or swellable in aqueous solvents. Such a layer serves for facilitating a subsequent cleaning step optionally to be carried out. Solid decomposition products formed in the course of the laser engraving may be deposited on this auxiliary layer and can be more easily removed.

Examples of the polymer soluble or at least swellable in aqueous solvents include polyvinyl alcohol, polyvinyl alcohol/polyethylene glycol graft copolymers, polyvinylpyrrolidone and its derivatives and cellulose derivatives, in particular cellulose esters and cellulose ethers, such as methylcellulose, ethylcellulose, benzylcellulose, hydroxyalkylcelluloses or nitrocelluloses. Mixtures of a plurality of polymers can of course also be used.

The additional laser-engravable polymer layer may also contain additives and assistants, for example plasticizers or laser absorbers. If it is intended to crosslink the laser-engravable relief layer photochemically, the additional polymer layer should as far as possible be transparent in the UV range. In the case of other crosslinking methods, this is not absolutely essential.

The thickness of the additional polymer layer should be very small. It depends substantially on the depth of focus of the laser used for engraving in the process. It is limited so that there is no substantial broadening of the focus on the surface of the relief layer. The thickness of such an additional polymer layer should as a rule not exceed 100 μm. As a rule, satisfactory results are no longer achieved in the case of greater thicknesses. The thickness should preferably not exceed 50 μM. The thickness is particularly preferably 1-40 μm, very particularly preferably 2-25 μm.

The laser-engravable flexographic printing element can optionally also comprise further layers.

Examples of such layers include an elastomeric lower layer comprising a different formulation, which is present between the substrate and the laser-engravable layer or layers and which need not necessarily be laser-engravable. The mechanical properties of the relief printing plates can be modified by means of such lower layers without the properties of the actual printing relief layer being influenced.

Resilient substructures which are present under the dimensionally stable substrate of the laser-engravable flexographic printing element, i.e. on that side of the substrate which faces away from the laser-engravable layer, serve the same purpose.

Further examples include adhesion-promoting layers which bond the substrate to layers located above or bond different layers to one another.

Furthermore, the laser-engravable flexographic printing element can be protected from mechanical damage by a protective sheet—also called cover sheet—which consists, for example, of PET and is present on the respective uppermost layer and which has to be removed before engraving by means of lasers. To facilitate peeling off, the protective sheet may have been surface-treated in a suitable manner, for example by siliconizing, provided that the top relief layer is not adversely affected in its printing properties by the surface treatment.

The flexographic printing element used as a starting material for the process can be produced, for example, by dissolving or dispersing all components in a suitable solvent and casting on a substrate. In the case of multilayer elements, a plurality of layers can be cast one on top of the other in a manner known in principle. After the casting, the cover sheet can, if desired, be applied for protecting the starting material from damage. Conversely, it is also possible to cast onto the cover sheet and finally to laminate with the substrate. The casting method is particularly advisable if thermal crosslinking is intended.

If thermoplastic elastomeric binders are used, the production of the flexographic printing element can particularly advantageously in a manner known in principle by melt extrusion between a substrate sheet and a cover sheet or a cover element and calendering of the composite obtained, as disclosed, for example, in EP-A 084 851. This method is particularly advisable if crosslinking is to be effected photochemically or by means of electron beams. In this way, it is also possible to produce thick layers in a single operation. Multilayer elements can be produced by means of coextrusion. Flexographic printing elements having metallic substrates can preferably be obtained by casting or extruding onto a temporary substrate and then laminating the layer with the metallic substrate.

The application of the additional polymer layer can be effected, for example, by dissolving the components in a suitable solvent and casting onto the relief-forming layer. Preferably, however, the cover sheet is coated with the additional polymer layer and laminated with the relief layer or used as a sheet for the extrusion process.

In the novel process, the starting material is first uniformly crosslinked in the first process step (a).

The uniform crosslinking of the crosslinkable relief layer can be carried out photochemically, in particular by exposure to UV-A radiation having a wavelength of from 320 to 400 nm or UV-A/VIS radiation having a wavelength of from about 320 to about 700 nm. Uniform thermochemical crosslinking is effected by very uniform heating of the relief-forming layer at constant temperature.

The photochemical crosslinking is particularly suitable for layers which contain no strongly colored absorbers for laser radiation and are transparent or at least substantially transparent in the UV/VIS range. However, transparent layers can of course also be crosslinked thermochemically. Layers containing colored laser absorbers can advantageously be crosslinked thermochemically.

The uniform crosslinking may also be carried out by means of electron beams.

Of course, the flexographic printing element used as a starting material for the process is usually produced by a printing plate manufacturer whereas the laser engraving is carried out by process engravers or printing works. The uniform crosslinking (a) can on the one hand be carried out by the process engravers themselves. For example, the photochemical crosslinking can be carried out in commercial exposure units for flexographic printing plates. On the other hand, the crosslinking can of course also be effected by the manufacturer of flexographic printing elements or on his premises.

In process step (b), a printing relief is engraved into the crosslinked relief-forming layer by means of a laser. If a protective sheet is present, this is removed prior to engraving.

The term laser-engravable is to be understood as meaning that the relief layer has the property of absorbing laser radiation, in particular the radiation of an IR laser, so that it is removed or at least detached in those parts where it is exposed to a laser beam of sufficient intensity. The layer is preferably vaporized or thermally or oxidatively decomposed without melting beforehand, so that its decomposition products are removed from the layer in the form of hot gases, vapors, fumes or small particles.

IR lasers are particularly suitable for engraving. For example, a $CO_2$ laser having a wavelength of 10.6 μm may be used. Furthermore, Nd-YAG lasers (1 064 nm), IR diode lasers or solid-state lasers may be used. It is also possible to use lasers having shorter wavelengths, provided that the laser has a sufficient intensity. For example, a frequency-doubled (532 nm) or frequency-tripled (355 nm) Nd-YAG laser or an excimer laser (e.g. 248 nm) may also be used.

The addition of absorbers for laser radiation depends substantially on the type of laser which is to be used for the engraving. As a rule, the substantially hydrophobic, elastomeric binders used for the relief-forming layer absorb the radiation of $CO_2$ lasers to a sufficient extent, so that additional IR absorbers in the relief layer are as a rule not required when this type of laser is used. The same applies to UV lasers, for example excimer lasers. In the case of Nd-YAG lasers and IR diode lasers, the addition of a laser absorber is generally necessary.

The image information to be engraved can be transferred directly from the layout computer system to the laser apparatus. The lasers can be operated either continuously or in pulsed mode.

Relief elements in which the sidewalls of the elements initially drop perpendicularly and broaden only in the lower region are advantageously engraved. A good shoulder shape of the relief dots together with little increase in tonal value is thus achieved. However, sidewalls of other designs can also be engraved.

The height of the elements to be engraved depends on the total thickness of the relief and on the type of elements to be engraved and is determined by a person skilled in the art according to the desired properties of the printing plate. The height of the relief elements to be engraved is at least 0.03 mm, preferably at least 0.05 mm, the minimum depth between individual dots being mentioned here. Printing plates having relief heights which are too small are as a rule unsuitable for printing by means of a flexographic printing technique, because the negative elements become full to overflowing with printing ink. Individual negative dots should usually have greater depths; for those of 0.2 mm diameter, a depth of at least from 0.07 to 0.08 mm is usually advisable. In the case of surfaces which have been removed by engraving, a depth of more than 0.15 mm, preferably more than 0.4 mm, is advisable. The latter is of course possible only in the case of an appropriately thick relief.

Advantageously, the flexographic printing plate obtained is cleaned in a further process step (c) after the laser engraving. In some cases, this can be effected by simply blowing off with compressed air or brushing off.

However, a liquid cleaning agent is preferably used for the subsequent cleaning, in order also to be able to remove polymer fragments completely. This is particularly advisable, for example, when food packaging which has to meet particularly stringent requirements with respect to volatile components is to be printed using the flexographic printing plate.

The subsequent cleaning can be very particularly advantageously effected by means of water or an aqueous cleaning agent. Aqueous cleaning agents substantially comprise water and optionally small amounts of alcohols and may contain assistants, for example surfactants, emulsifiers, dispersants or bases, for promoting the cleaning process. It is also possible to use mixtures which are usually used for developing conventional, water-developable flexographic printing plates. Since the relief layer comprising the substantially hydrophobic, elastomeric binder is not swellable in water, time-consuming drying of the printing plate is avoided by the use of water or aqueous cleaning agents.

The subsequent cleaning can be effected, for example, by simple immersion or spraying of the relief printing plate or can additionally be promoted by mechanical means, for example by brushing or treatment with a plush pad. It is also possible to use conventional flexographic plate washers.

In the subsequent washing step, any deposits and the residues of the additional polymer layer are removed. This layer advantageously prevents polymer droplets formed in the course of the laser engraving from becoming firmly bonded again to the surface of the relief layer, or at least makes it more difficult for this to occur. Deposits can therefore be particularly readily removed. It is as a rule advisable to carry out the subsequent washing step immediately after the laser engraving step.

Although not the preferred variant, it is also possible in principle to use mixtures of organic solvents for the subsequent cleaning, in particular those mixtures which usually serve as washout agents for conventionally produced flexographic printing plates. Examples include washout agents based on high-boiling, dearomatized mineral oil fractions, as disclosed, for example, in EP-A 332 070, or water-in-oil emulsions, as disclosed in EP-A 463 016. This variant can be used in particular when no additional polymer layer is present. If an additional polymer layer is present but cannot be removed with the organic solvent used, cleaning must additionally be effected with water or an aqueous cleaning agent.

The flexographic printing plates obtained are particularly suitable for printing with water-based inks and alcohol-based inks. However, they are of course also suitable for printing with UV inks or flexographic printing inks which contain small amounts of esters.

The examples which follow illustrate the invention:

General Preparation Method for the Starting Material:

A photochemically crosslinkable laser-engravable relief-forming layer was produced from, in each case, 55% by weight (based on the sum of all components) of a hydrophobic elastomeric binder (Kraton D-1102, SBS block copolymer), 32% by weight of a plasticizer, 10% by weight of hexanediol diacrylate, 2% by weight of photoinitiator and 1% of dye and heat stabilizer.

The components were processed using an extruder (ZSK 53) at 140° C., introduced by means of a slot die between a dimensionally stable PET substrate sheet and a PET protective sheet and then calendered by means of a two-roll calender. The thickness of the resulting crosslinkable, laser-engravable layer was in each case 1.14 mm.

Plasticizers used were the plasticizers shown in table 1. Inert plasticizers of substantially paraffinic mineral oils, which have no ethylenically unsaturated double bonds, were used for examples 1 and 2, and polybutadiene oils which have ethylenically unsaturated double bonds in the chain or in the side groups were used for the comparative examples.

TABLE 1

Plasticizers used for experiments and comparative experiments

| | Type |
|---|---|
| Example 1 | White oil S 5000 (BASF) |
| Example 2 | Medical white oil (Ondina oil G 34, from Shell) |
| Comparative example 1 | Polybutadiene oil (Nisso PB 1000, from Nippon Soda Co., Ltd.) |
| Comparative example 2 | Polybutadiene oil (Polyöl 130, from Degussa) |

Carrying Out the Novel Process:

The protective PET sheet was peeled off from the laser-engravable flexographic printing elements obtained in the examples and comparative examples. They were uniformly crosslinked by exposure to UVA light for 20 minutes in a first process step. In examples 1 and 2, additional crosslinking of the uppermost region of the relief layer was carried out using UVC light.

Laser Engraving of the Flexographic Printing Elements

A $CO_2$ laser (from ALE, type "ALE meridian finesse") having a spot diameter of about 30 μm and a rated power of 250 watt was used for laser engraving experiments. The power on the plate surface at maximum power was 150 watt. The laser engraving experiments were carried out using the following software parameters: Total relief=75, First step=48, Engraving speed=240 rpm and Shoulder base width=1.24.

After the flexographic printing element had been clamped on a cylinder, a test motif consisting of various, typical, positive and negative elements was engraved into the flexographic printing element. In addition to surface areas completely removed by engraving and 100% tonal values, the motif also contained various screen areas having tonal values of from 1 to 98% and 40 μm wide negative lines in the axial and transverse directions relative to the axis of rotation of the cylinder.

Results

The engraving depth was from 0.64 to 0.685 mm in the case of all flexographic printing plates. However, the plates of examples 1 and 2 which were produced according to the invention and comprised inert plasticizers had substantially no melt edges, whereas the plates of comparative examples 1 and 2 comprising reactive plasticizers had substantial melt edges in comparison therewith.

After the laser engraving, the flexographic printing plates obtained were washed for two minutes with a mixture of water and a surfactant with simultaneous brushing of the surface. A nyloprint® washer (apparatus combination CW 22×30, BASF Drucksysteme GmbH) was used for this purpose.

The plates comprising inert plasticizer were washed for 5 minutes and those comprising reactive plasticizer for 10 minutes at 60° C. Nevertheless, in spite of twice the washing time a substantial residue of removed material is still detectable on the flexographic printing plates comprising reactive plasticizers, whereas the flexographic printing plates comprising the inert plasticizers used according to the invention have been cleaned so that no residue is left.

The flexographic printing plates obtained are suitable for printing with alcohol-based and water-based inks.

I claim:

1. A process for the production of flexographic printing plates by means of laser engraving, in which the starting material used is a crosslinkable, laser-engravable flexographic printing element which at least comprises, arranged one on top of the other, a dimensionally stable substrate, at least one crosslinkable, laser-engravable relief-forming layer having a thickness of at least 0.2 mm, at least comprising an essentially hydrophobic elastomeric binder, a plasticizer and components for crosslinking, and which process comprises at least the following steps:

(a) uniform crosslinking of the relief-forming layer and (b) engraving of a print relief into the crosslinked relief layer with the aid of a laser, the height of the relief elements to be engraved with the laser being at least 0.03 mm, wherein the plasticizer is an inert plasticizer selected from the group consisting of aromatic, naphthenic and paraffinic mineral oils.

2. A process as claimed in claim 1, wherein the inert plasticizer is a paraffinic and/or naphthenic mineral oil.

3. A process as claimed in claim 1, wherein the plasticizer is used in an amount of from 5 to 40% by weight, based on the amount of all components of the relief-forming layer.

4. A process as claimed in claim 3, wherein the plasticizer is used in an amount of from 20 to 40% by weight, based on the amount of all components of the relief-forming layer.

5. A process as claimed in claim 1, wherein the binder is a thermoplastic elastomeric binder.

6. A process as claimed in any claim 1, wherein the uniform crosslinking (a) is carried out photochemically or thermally.

7. A process as claimed in claim 1, wherein the relief-forming layer additionally comprises an absorber for laser radiation.

8. A process as claimed in claim 1, wherein the flexographic printing element comprises an additional, water-soluble laser-engravable layer which is arranged on the laser-engravable relief-forming layer and comprises at least one polymer soluble or swellable in aqueous solvents and which is removed after process step (b) in a further process step (c) by means of water or an aqueous cleaning agent.

9. A process as claimed in claim 8, wherein the polymer is at least one polymer selected from the group consisting of polyvinyl alcohol, polyvinyl alcohol/polyethylene glycol graft copolymers, polyvinylpyrrolidone and cellulose derivatives.

10. A flexographic printing plate obtainable by a process as claimed in claim 1.

11. The use of a flexographic printing plate as claimed in claim 10 for flexographic printing with water-based and/or alcohol-based printing inks.

* * * * *